US005398755A

United States Patent [19]

Eslinger et al.

[11] Patent Number: 5,398,755

[45] Date of Patent: Mar. 21, 1995

[54] STRESS RINGS FOR INFLATABLE PACKERS

[75] Inventors: David M. Eslinger, Broken Arrow, Okla.; Robert M. Sorem, Sugar Land, Tex.

[73] Assignee: Dowell Schlumberger Incorporated, Sugar Land, Tex.

[21] Appl. No.: 127,649

[22] Filed: Sep. 28, 1993

[51] Int. Cl.[6] ..... E21B 33/127

[52] U.S. Cl. ..... 166/187

[58] Field of Search ..... 166/187, 120, 122, 195, 166/212, 302, 310

[56] References Cited

U.S. PATENT DOCUMENTS 4,057,108 11/1977 Broussard ..... 166/310 X 4,424,858 1/1984 Elliot et al. ..... 166/302 X 4,768,590 9/1988 Sanford et al. ..... 166/187

4,923,007 5/1990 Sanford et al. ..... 166/187

*Primary Examiner*—William P. Neuder

*Attorney, Agent, or Firm*—Stephen A. Littlefield

[57] ABSTRACT

An inflatable packer for use in a well includes a tubular mandrel, an inner elastomer sleeve on the mandrel, armor surrounding the inner sleeve, and an outer elastomer sleeve member that covers at least a portion of the armor. Stress rings are mounted on end portions of the armor are made from a metal plate which has been highly cold-worked in both its longitudinal and transverse directions to provide optimum strength characteristics against stresses imposed thereon when the packer is inflated.

5 Claims, 2 Drawing Sheets

STRESS RINGS FOR INFLATABLE PACKERS

FIELD OF THE INVENTION

This invention relates generally to improvements in inflatable packers used to bridge a well bore, and particularly on an inflatable packer having stress rings at the opposite ends of the packer element that are made in a manner which provides optimum strength properties in the direction of maximum principal stresses when the packer is expanded.

BACKGROUND OF THE INVENTION

Inflatable packers that are in common use in the oil exploration and workover industry have an elongated internal elastomer sleeve that is surrounded by protective armor, for example circumferentially spaced, overlapped metal slats, reverse-layed cables, or composite constructions such as woven cables or wires. Such armor is designed to protect the elastomer sleeve from abrasions and cuts as it is expanded outward by fluid under pressure. An external elastomer sleeve may surround all or part of the armor to provide a seal against a surrounding well bore wall. A single inflatable packer can be used to provide a bridge plug in the well bore, or a straddle arrangement of upper and lower inflatable packers can be used to perform well service operations off bottom.

The upper and lower ends of the armor usually are attached by welding or the like to collars on the packer mandrel to form a unitary assembly. The opposite end portions of the armor assembly extend underneath stress rings which are mounted adjacent the collars. When the packer is expanded to its full diameter, large hoop stresses are generated in the stress rings by outward pressure of the armor end portions which may curve outward at a fairly sharp radius. Thus the strength of such stress rings is a design consideration of high importance in the successful operation of an inflatable packer.

In the past, such stress rings have been machined from conventional metal bar stock. Although increased strength of the machined stock can be achieved by cold-working, optimum strength cannot be achieved using relatively large bar (for example greater than 1.5 inches diameter) due to practical cold working limitations. Moreover, cold-worked bar properties are optimum along the axis of the bar, while the stress rings of an inflatable packer experience high hoop stresses on account of their radial loading by the end portions of the armor. Thus a stress ring made in a conventional manner has a tendency to crack and split in radial directions and cause downhole packer malfunctions which are highly undesirable.

A general object of the present invention is to provide a new and improved inflatable packer having stress rings which are manufactured in a way such that the stress rings have optimum strength in view of the principle stresses that are generated therein as the packer element is expanded.

SUMMARY OF THE INVENTION

This and other objects of the present invention are attained through the use of stress rings that are made from a cold-worked billet or plate which has been highly cold-worked in both its transverse and longitudinal directions. The plate then is age-hardened after rolling to optimize its strength. The stress ring blanks then are machined from the plate with their longitudinal axes at right angles to such cold-working directions, and then given final machining to the desired dimensions and geometry. It has been found that stress rings made in this manner have greatly increased hoop strength potential (25% or more) due to their formation in accordance with this invention, which substantially minimizes the possibility of packer failure in the well due to the formation of cracks in such stress rings.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
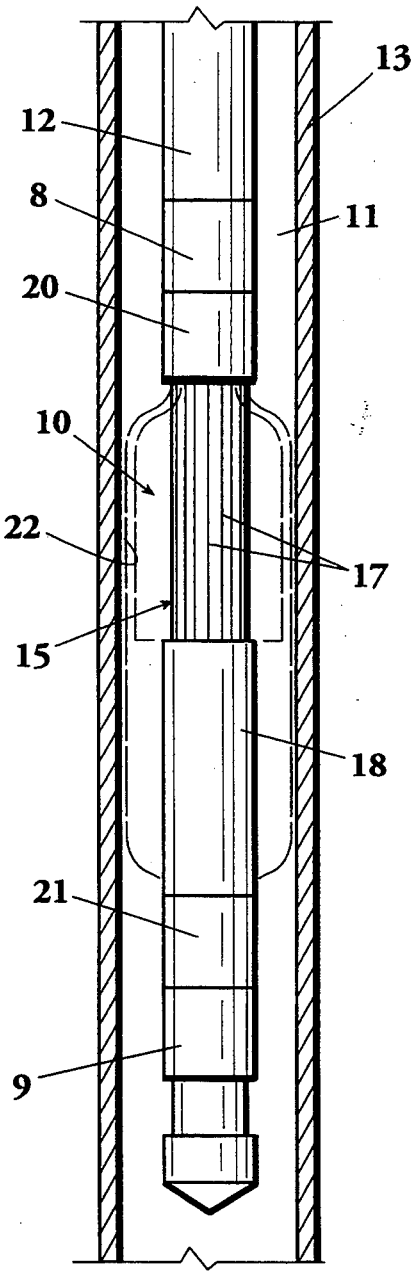
FIG. 1 is a somewhat schematic view of an inflatable packer disposed in a well bore.

Referring initially to FIG. 1, an inflatable packer indicated generally at 10 is shown suspended in a well bore 11 on a running string 12 of jointed or coiled tubing. The well bore 11 can be cased, as shown at 13, or can be uncased (open hole). The packer 10 includes a tubular body or mandrel 4 (FIG. 4) that carries upper and lower metal collars 8, 9 and inside retainer rings to which the respective upper and lower ends of an inner elastomeric sleeve member 16 are secured. The sleeve member 16 is surrounded by a suitable armor arrangement, such as a plurality of circumferentially spaced, overlapped metal straps 17. Other armor arrangements that can be used are reverse-layed cables, or woven composites of cables or wires. An outer elastomer sleeve 18 (FIG. 1) can cover all or a longitudinal portion of the armor 17. The opposite ends of the straps 17 or cables are welded or otherwise secured at 7 to additional inner rings 3, which can be fixed to the collars 8, 9 by pins 6 or the like. When fluid under pressure is applied to the inner surfaces of the sleeve 16 via the annular space 5 outside the mandrel 4, the sleeve together with the armor 17 and the outer elastomer sleeve 18 are expanded outward until the sleeve 18 engages and seals against the surrounding well wall to bridge or pack off the well bore 11. The exposed lengths of the armor 17 also engage the well bore wall to provide a friction-type anchor against longitudinal movement.

In order to confine the end portions 25 of the armor 17 which are adjacent the collars 8 and 9, stress rings 20 and 21 are employed. As shown in further detail in FIG. 4, the upper stress ring 20 is constituted by a generally tubular metal body 22 having a cylindrical outer surface 23 that can be slightly larger than the outer diameter of the collar 8. The ring 22 has an inner surface 24 that fits closely around the end 17 of the armor portions 25. The outer end surface 26 of the ring 20 is flared outward as shown to prevent sharp bending of the armor 17 as the packer element 15 is expanded. The lower stress ring 21 is configured in the same manner, but is the inverted or mirror image of the upper ring 20.

Figure 2:
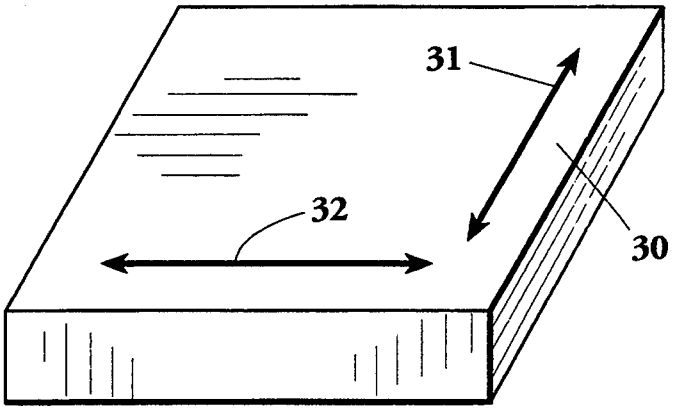
FIG. 2 is an isometric view of a metal plate from which stress rings in accordance with this invention are made.

The stress rings 20 and 21 are made from a relatively thick metal billet or plate 30 which is worked in a certain manner to increase its strength properties as shown in FIG. 2. The plate 30 is highly cold-worked in both the longitudinal and transverse directions as shown by the arrows 31 and 32, and to approximately the same degree in both of such directions. The plate 30 then is age hardened to give optimum strength, although such hardening can be done after machining.

Figure 3:
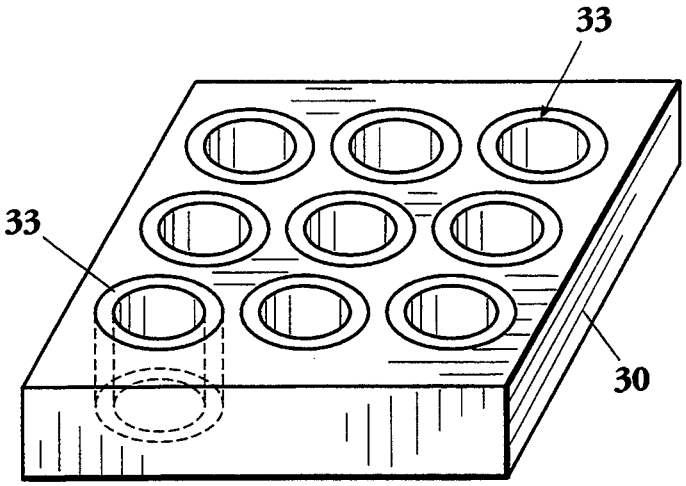
FIG. 3 is an isometric view to illustrate how a number of stress ring blanks are machined from the plate of FIG. 2.
Figure 4:
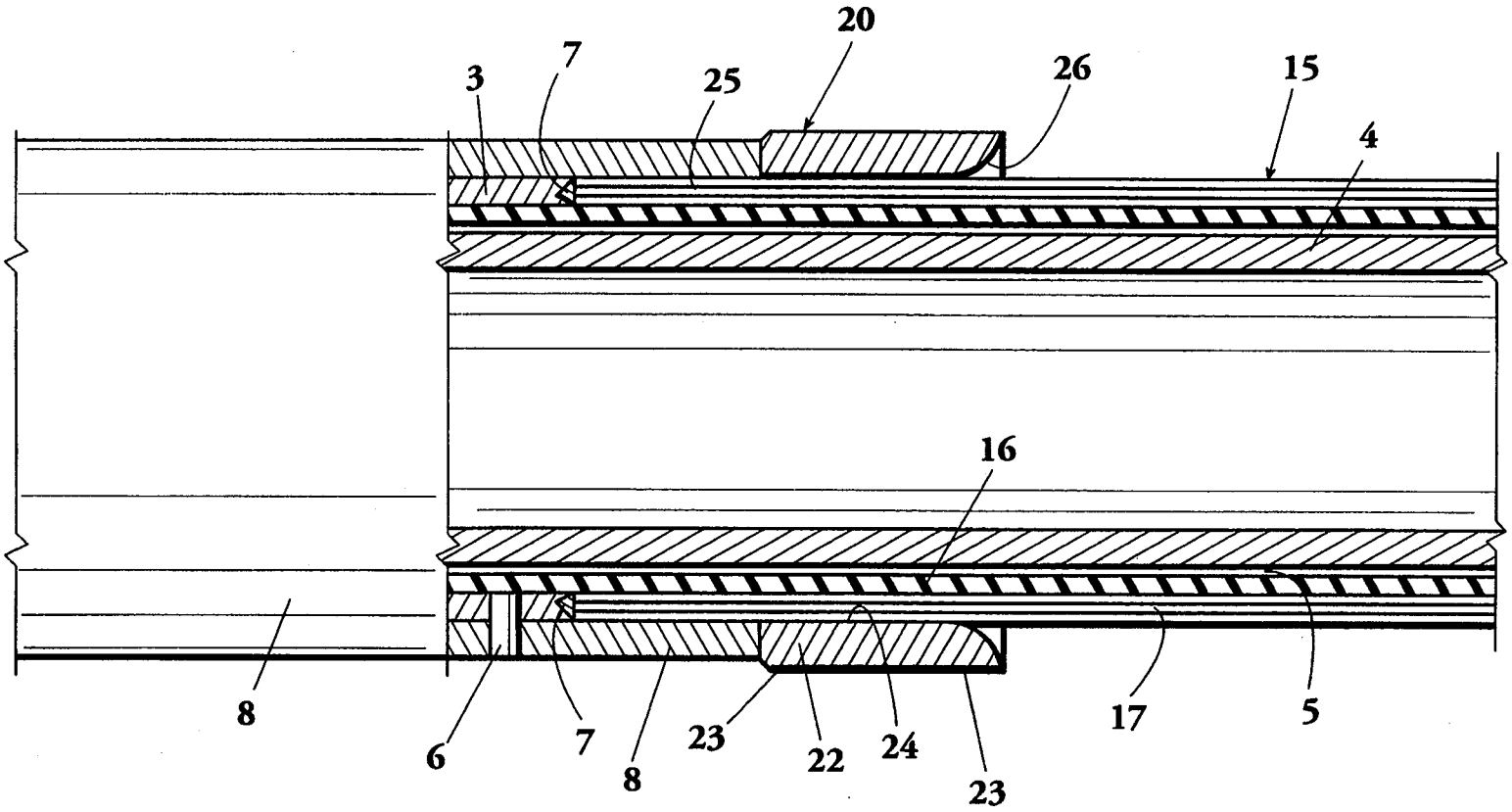
FIG. 4 shows a sectional view of a part of an inflatable packer having a machined stress ring that has been made in accordance with this invention.

The stock or blanks for the stress rings 20 and 21 then are machined from the plate 30 as shown in FIG. 3 where a plurality of such tubular blanks 33 are shown. The blanks 33 preferably are machined from the plate 30 using an electron discharge machine, although other cutting machines can be used. A fully finished ring 20 or 21 is shown in FIG. 4 as noted above. The properties of the cold-worked plate 30 are such that the stress rings made from it, as disclosed herein, have optimum hoop strength to resist deformation in response to outward pressures imposed thereon by the end portions 25 of the armor 17 when the packer element 15 is inflated and expanded in response to pressure applied to the inside of the elastomer sleeve 16.

OPERATION

In operation, the inflatable packer 10, assembled and fabricated as shown in the drawings, is lowered into the well bore 11 on the running string 12 until the packer is at a particular depth where it is to be expanded to provide a bridge in the well bore. As fluid pressure is applied via the running string 12 to the inside of the inner elastomer sleeve 16, such sleeve, the armor 17 and the outer elastomer sleeve 18 are expanded outward as shown in phantom lines in FIG. 1 until the outer sleeve engages the well bore wall 22. Any exposed portions of the armor 17 also engage the wall 22 to provide additional anchoring through frictional engagement.

The upper and lower end portions 25 of the armor 17 are caused to curve outward on the smooth radius surfaces 26 on the stress sleeve ends during expansion of the packer element 15. Thus these portions are not permanently deformed and will resile inward to their original relaxed conditions when inflation pressure is released. When the packer element 15 is expanded, the pressures imposed on the stress rings 20, 21 by the underlying portions 25 of the armor 17 are directed in generally radial outward directions, which generate hoop stresses therein. However the strength properties of rings 20, 21 which have been made from cold-worked plates in the manner disclosed herein have optimum strength in the hoop mode, and thus have high resistance to yielding or cracking in the presence of such stresses.

It now will be recognized that an inflatable packer having new and improved stress rings having optimum hoop strength characteristics has been disclosed. Such rings are made from a steel plate that has been heavily cold-worked in its longitudinal and transverse directions, and then age hardened. The rings are machined from the plate with their longitudinal axes at a right angle to the plate thickness to provide optimum strength properties when used in the inflatable packer. Since certain changes or modifications may be made in the disclosed embodiment without departing from the inventive concepts involved, it is the aim of the appended claims to cover all such changes and modifications falling within the true spirit and scope of the present invention.

What is claimed is:

1. In an inflatable packer having a tubular body that carries an inner elastomer sleeve, armor means covering said sleeve, and an outer elastomer sleeve covering at least a portion of said armor means, the combination comprising stress rings mounted around the end portions of said armor means, said stress rings each being formed from a metal plate that has been cold-worked in both longitudinal and transverse directions to provide optimum strength properties respecting hoop stresses therein caused by inflation of said packer.

2. The packer of claim 1 wherein each of said stress rings has a longitudinal axis which is at a right angle to said directions of cold-working of said plate.

3. The packer of claim 2 wherein each of said stress rings has an outwardly flared end surface for controlling the bending radius of said end portions of said armor means.

4. The packer of claim 3 wherein said armor means includes circumferentially spaced, overlapping slats which slide laterally relative to one another during expansion.

5. A stress ring arranged to surround an end portion of the armor means which protects an inner elastomer sleeve of an inflatable packer, comprising: a generally tubular metal body member machined from a metal plate that has been highly cold-worked in longitudinal and transverse directions to provide optimum strength properties respecting hoop stresses generated therein caused by inflation of said inner elastomer sleeve and expansion of said sleeve and said armor means.

* * * * *